US011491075B2

(12) United States Patent
Fuster

(10) Patent No.: US 11,491,075 B2
(45) Date of Patent: Nov. 8, 2022

(54) MASSAGE HEAD AND MASSAGE EQUIPMENT EMPLOYING SUCH A HEAD

(71) Applicant: LPG SYSTEMS, Valence (FR)

(72) Inventor: Arnaud Fuster, Beaumont les Valence (FR)

(73) Assignee: LPG SYSTEMS, Valence (FR)

( * ) Notice: Subject to any disclaimer, the term of this patent is extended or adjusted under 35 U.S.C. 154(b) by 488 days.

(21) Appl. No.: 16/606,593

(22) PCT Filed: Apr. 19, 2018

(86) PCT No.: PCT/EP2018/059975
§ 371 (c)(1),
(2) Date: Oct. 18, 2019

(87) PCT Pub. No.: WO2018/197317
PCT Pub. Date: Nov. 1, 2018

(65) Prior Publication Data

US 2021/0196556 A1 Jul. 1, 2021

(30) Foreign Application Priority Data

Apr. 26, 2017 (FR) ..... 1753629

(51) Int. Cl.
*A61H 7/00* (2006.01)

(52) U.S. Cl.
CPC ..... *A61H 7/004* (2013.01); *A61H 2007/009* (2013.01); *A61H 2201/0214* (2013.01);
(Continued)

(58) Field of Classification Search
CPC ..... A61H 2203/03; A61H 7/00; A61H 7/004; A61H 7/007; A61H 7/008;
(Continued)

(56) References Cited

U.S. PATENT DOCUMENTS 5,843,006 A 12/1998 Phillips et al.
7,153,282 B1 * 12/2006 Dudley ..... A61H 7/004 601/93
(Continued)

FOREIGN PATENT DOCUMENTS

EP 0224422 B1 2/1990
EP 1225094 A2 7/2002
(Continued)

OTHER PUBLICATIONS

International Search Report issued in PCT Patent Application No. PCT/EP2018/059975 dated May 28, 2018.

*Primary Examiner* — Justine R Yu
*Assistant Examiner* — Matthew R Moon
(74) *Attorney, Agent, or Firm* — Marshall, Gerstein & Borun LLP

(57) ABSTRACT

This massage head includes a housing, having two active members emerging from the lower surface thereof, having its free lower edge, opposite to the housing, intended to be in contact with a patient's skin. One at least of said active members is formed of a flap hinged within the housing and capable of being pivoted to bring the lower edges of said active members closer to each other or draw them away from each other, the relative displacement of said at least one flap being ensured by means of a rotary cam formed within the housing, the rotation axis of the cam being oriented substantially parallel to the displacement direction of said at least one flap. The cam includes at least one cam track formed on its periphery, intended to cooperate with the flap support(s), having one or their ends hinged in the housing.

18 Claims, 7 Drawing Sheets

(52) U.S. Cl.
CPC ..... *A61H 2201/102* (2013.01); *A61H 2201/1215* (2013.01); *A61H 2201/1238* (2013.01); *A61H 2201/1418* (2013.01); *A61H 2201/1678* (2013.01)

(58) Field of Classification Search
CPC ..... A61H 2007/009; A61H 2201/0214; A61H 2201/102; A61H 2201/12; A61H 2201/1215; A61H 2201/123; A61H 2201/1238; A61H 2201/14; A61H 2201/1418; A61H 2201/1436; A61H 2201/1463; A61H 2201/1481; A61H 2201/149; A61H 2201/1678; A61H 2201/169
See application file for complete search history.

(56) References Cited

U.S. PATENT DOCUMENTS

| | | | | |
|---|---|---|---|---|
| 2007/0255188 | A1* | 11/2007 | Tseng ..... | A61H 7/007 601/93 |
| 2010/0036298 | A1* | 2/2010 | Fuster ..... | A61H 7/008 601/134 |
| 2018/0133095 | A1* | 5/2018 | Ishikawa ..... | A61H 7/007 |

FOREIGN PATENT DOCUMENTS

| | | | | |
|---|---|---|---|---|
| EP | 0917452 | B1 | 7/2003 | |
| FR | 584554 | A | 2/1925 | |
| FR | 1465964 | A | 1/1967 | |
| FR | 2934775 | A1 | 2/2010 | |
| KR | 100786655 | * | 12/2021 | ..... A61H 15/00 |

* cited by examiner

MASSAGE HEAD AND MASSAGE EQUIPMENT EMPLOYING SUCH A HEAD

TECHNICAL FIELD

The present disclosure relates to a massage head, intended for mobilizing the skin tissue. It also relates to massage equipment using such a head.

The object of the disclosed embodiments is the simple and efficient implementation of massage operations, and this, on human beings as well as on animals.

BACKGROUND

Different massaging techniques, generally depending on the treatments to be performed, are known. Generally, they aim at exerting on the patient actions using phenomena of pressure and/or displacement and/or pinching, particularly of the skin tissue.

A large number of devices have been provided to make the masseur's action easier. Among these, the use of devices using a simple mechanical action, for example, by means of assemblies comprises balls assembled on a support housing, possibly enabling to distribute or to simultaneously apply a treatment product of cream or gel type such as for example described in document FR A 1 225 094, has first been provided.

It has also been provided to associate to this mechanical treatment a treatment of suction of the patient's skin. To achieve this, the concerned massage equipment uses a treatment head connected to a suction circuit, said treatment head being formed of a housing defining an inner chamber having the suction circuit emerging into it. When the massage head is applied against the patient's body, and due to the suction generated by the suction circuit, a skinfold forms within the internal chamber, which skinfold bears against the peripheral edge of said internal chamber.

The mechanical action may be exerted by rollers or balls which enable to exert, simultaneously to the suction on the patient's body, an action of pressure and/or displacement and/or friction, particularly by vibration.

The solutions provided in this context result in complex assemblies, which are difficult to form, and which are not fully satisfactory in terms of results.

Massage equipment capable of simply reproducing subdermal-tissue-type massages, that is, comprising a continuous action on the patient, causing not only a local pinching of the skin tissue, but also a progressive displacement of the pinched area to cause a rolling of said skinfold and, this, while exerting a pressure (see, for example, EP A 224 422), has already been provided.

Such equipment comprises a manually-actuatable housing having two parallel rollers, assembled to freely rotate or positively rotated within the housing, assembled therein. The rollers may be assembled on the housing with a fixed center-to-center distance, or are conversely capable of automatically moving away and coming closer to each other during the massage operation, said housing being itself connected to suctions means enabling to create a depression between said rollers when the head provided between these different elements is applied against the patient's body, to form a skinfold bearing against the roller surface.

In document EP 0 917 452, it has been provided to replace the rollers with two walls placed inside of the housing, hinged inside thereof to be able to be pivoted, said housing being, here again, connected to a suction source. Under the action of the suction, a skinfold is created, which inserts between the two walls inside of the housing. Due to the progress in one direction or the other of the massage head fitted with such a device against the patient's skin, the skinfold thus formed is submitted to a jerky pinching.

The device may be further improved by the implementation of an electrovalve at the level of the suction circuit, which enables to obtain an operation in "all or nothing", but which also enables to define a controlled rate of the air flow between two determined values, with a possibility of adjustment between said values.

Such an electrovalve assembled on the suction circuit thus enables to obtain a sequential pulse operation, having a pace such that during the massaging operation, the suction rate cyclically varies, thus resulting in an effect of vibration, of variation of the suction skin catching force, and further easing the implementation thereof.

In the absence of an action, the two walls are maintained spaced apart from each other, for example, by means of springs or of magnets, the pivoting of said walls and thus their coming together resulting from the effect of the vacuum and/or of the depression generated inside of the housing.

To further improve the above-described device, a massage head of the type in question, provided with two flaps capable of being pivoted to bring their lower edges closer to each other or draw them away from each other when they are in contact with the skinfold has been provided in document FR 2 934 775, the relative displacement of the flap being ensured by means of a motor-driven rotary cam, oriented axially with respect to the massage head and having its cam track cooperating with said flap flaps, to induce the pivoting motion thereof.

The massage head thus enables, first, to do away with any suction source. The skinfold thus results from the mechanical action generated by the free lower edge of said flaps.

If, undoubtedly, the massage head enables to improve the massage/pinch technique, due to the flap motorization technique, it is necessary, to have a larger amplitude of the flap action, to increase the diameter of the cam, and thus, as a corollary, the bulk generated by the head, which affects, on the one hand, its implementation and, on the other hand, its user-friendliness.

The object of the present embodiments is, first, to optimize the operation of the device described in the previous document, particularly in terms of amplitude of the angular motion of the flaps, and of their action exerted at the level of the patient's skin and, on the other hand, to decrease its bulk.

SUMMARY OF THE SPECIFICATION

The presently described embodiments thus aim at a massage head comprising a housing, having two active members emerging from the lower surface thereof, having its free lower edge, opposite to the housing, intended to be in contact with a patient's skin, one at least of said active members being formed of a flap hinged within the housing and capable of being pivoted to bring the free lower edges of said active members closer to each other or to draw them away from each other along a displacement direction. The relative displacement of said at least one flap with respect to the housing is ensured by means of a motor-driven rotary cam formed within the package.

According to various embodiments of the disclosure:

the rotation axis of the cam is oriented substantially parallel to the displacement direction of the flap.

the cam comprises at least one cam track formed on its periphery.

said flap is assembled on a support having one of its ends hinged in the housing, said support being provided with a member capable of cooperating with the cam track.

Active member designates any member intended to come into contact with the patient's skin, especially to generate a skinfold. Thus, and according to an embodiment, the active members are respectively formed of a fixed wall and of a flap, the skinfold resulting from the mobilization of the flap only. In an advantageous embodiment, the active members are both formed of a flap, and the relative displacement of one with respect to the other will also induce the forming of the skinfold and the pinching thereof or, more generally, a mobilization of the skin tissue.

In other words, embodiments comprise forming a cam within the housing, modifying the orientation of the cam and more specifically of the cam track(s) fitting it, as well as that of its hinge line and, on the other hand, modifying the cooperation between the cam and the flap(s). As will be developed hereafter, such a structure change enables to simply obtain a significant increase of the angular motion of the free lower edge of the flap(s), as well as to vary the torque, and thus, as a corollary, the stress exerted by said free lower edges on the patient's skin.

According to a first embodiment, the cam tracks are each formed of a continuous recess formed at the periphery of the cam, and the member of the support of the flap(s) cooperating with said cam track is formed of at least one pin received in said recess.

According to another embodiment, the cam tracks are each formed of a continuous outgrowth protruding from the periphery of the cam, and the member of the support of the flap(s) cooperating with said cam track is formed of at least one fork having its teeth positioning on either side of said outgrowth.

According to an advantageous feature, the end of the active members, intended to come into contact with the patient's skin, is formed of a removable end piece reversibly affixed either on the flap support or on the fixed wall. Such end pieces may take different configurations and shapes and further be made of a flexible and/or abrasive material, or even be capable of delivering perfumed scents or of generating an icy feeling.

Further, one at least of the end pieces may be formed of a freely rotating roller having its rotation axis oriented parallel to the hinge line of the flap support within the housing, or perpendicularly to the cam rotation axis.

According to embodiments, the cam rotation is ensured by means of a fixed geared motor within the cam, having the rotation shaft of its reduction gear generating the rotation of a peripheral sleeve fitting the cam, having the cam track(s) formed thereon.

According to another variation, the cam rotation is ensured by a toothed wheel meshing with a pinion rigidly fastened to the cam, said toothed wheel being motor-driven by a motor external to the housing or by a geared motor assembled within the housing, and having its drive shaft ensuring the rotation of said toothed wheel.

Embodiments also aim at a massage device implementing such a massage head, and comprising an electric power source capable of powering the electric motor itself driving the reduction gear or the motor ensuring the rotation of the cam.

Such a device is also capable of comprising a vacuum or depression source associated with the massage head, and emerging into it, said housing then defining an inner chamber having the skinfold formed therein when it is applied onto a patient's skin, the chamber being defined by two fixed lateral walls, and by two transverse walls formed by the flaps and the flap supports.

According to another feature, the housing of the massage head is reversibly rigidly fastened to the massage head by means of resilient members or clips or equivalent systems, the electric motor and the electric power supply being confined at the level of the head only.

DETAILED DESCRIPTION OF THE SPECIFICATION

Figure 1:
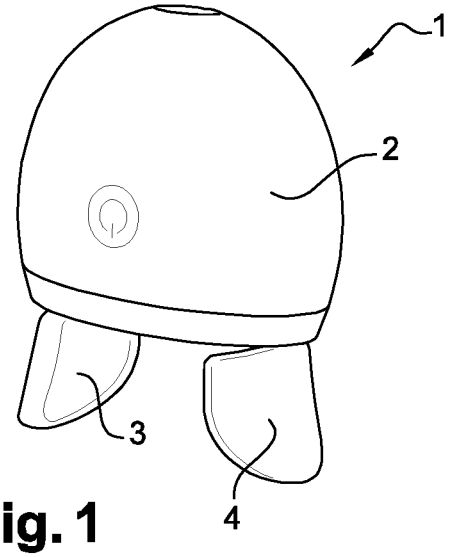
FIG. 1 is a simplified perspective representation of a first embodiment of the massage head according, comprising no suction or depression application system.

A massage head according to its most simplistic form is described in relation with FIG. 1. Such a massage head (1) comprises a housing (2), having the elements necessary to the operation of the massage head, and more specifically to the displacement of flaps (3 and 4) with respect to said massage head (1) integrated therein. The flaps form the active members.

In such a simple embodiment, the massage head limitingly operates mechanically, that is, in the absence of any suction or depression source, the skinfold being only formed by the actuating of the flaps (3 and 4) and particularly by their respective lower edges being brought towards each other or driven away from each other.

Figure 2:
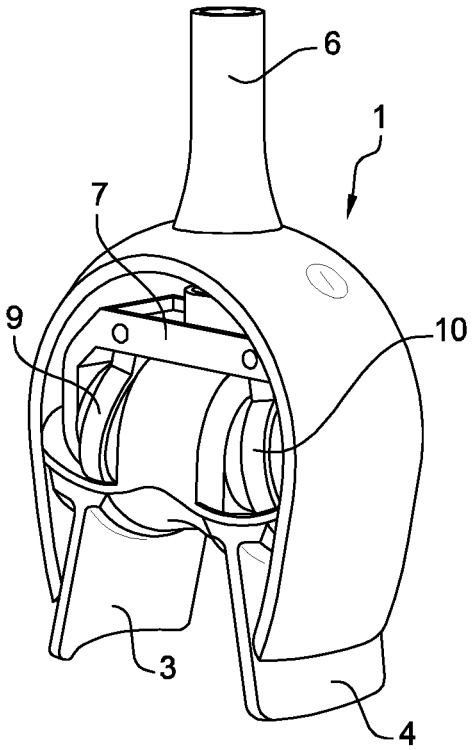
FIGS. 2 and 3 are partial simplified views of the massage head, both provided with a suction and depression application system with a variation at the level of one of the flaps.
Figure 3:
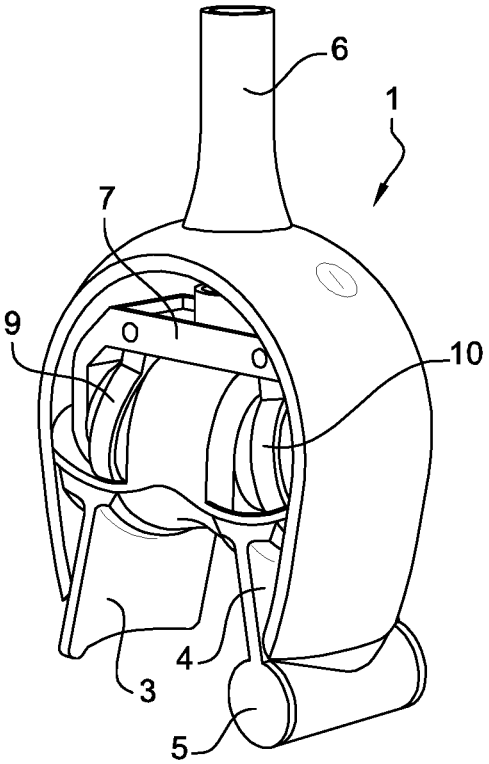
Figure 4:
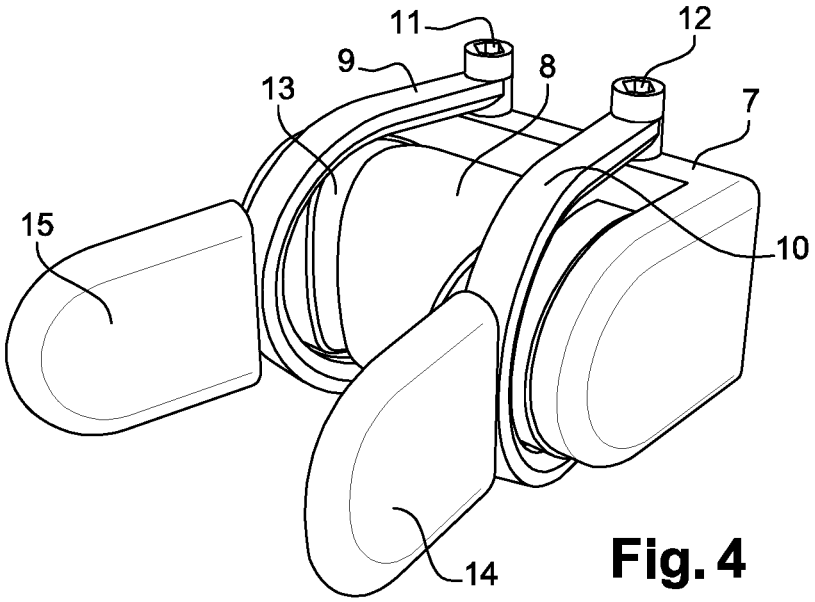
FIGS. 4 and 5 are simplified perspective representations of the means ensuring the flap pivoting, respectively with the cam oriented at 0° and at 90° with respect to its rotation.
Figure 5:
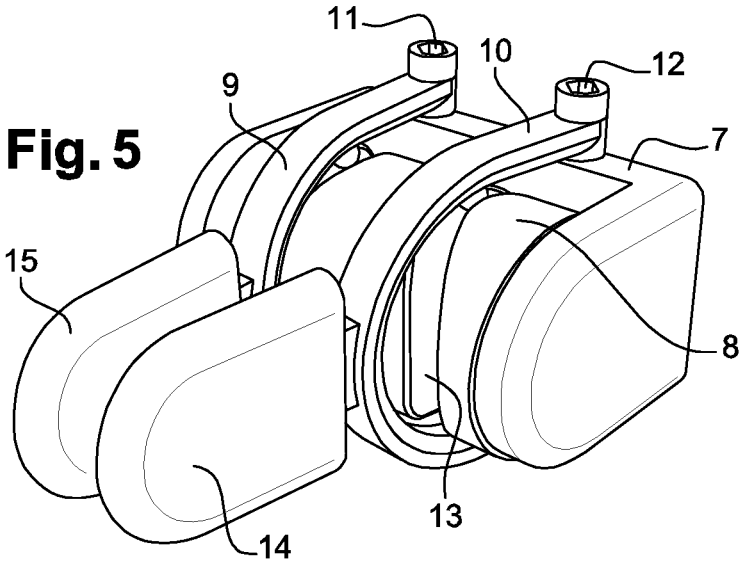

FIGS. 2 and 3 are views similar to FIG. 1, except that the head described therein integrates an end piece (6) coupled to a depression or suction source.

In other words, the massage head is capable of operating with or without a depression or suction source.

As indicated as a preamble, embodiments are more particularly directed towards the means ensuring the displacement of the flaps (3 and 4).

For this purpose, and as can be better observed in FIGS. 4 to 8, the displacement of the flaps (3 and 4) is ensured by means of a rotary cam (8) which, in this particular embodiment, has a cylindrical sheath. The rotary cam (8) is received in a support (7) itself rigidly fastened to the housing (2).

The rotation axis of the rotary cam (8) is oriented substantially parallel to the displacement direction of the flaps (3 and 4).

More particularly, the flaps (3 and 4) are formed of flap supports (9 and 10). One of the ends (20, 21) of these supports is hinged on the support (7), said ends (20, 21) being pierced with through openings cooperating with a screw/nut system (11, 12, 18, 19) capable of fastening them to said support, while allowing their rotation with respect to the hinge line thus defined.

The other free end (22, 23) of the supports (9 and 10) receives the end pieces (14 and 15) of the flaps (3 and 4), that is, the active areas of the flaps intended to come into contact with the patient's skin.

The end pieces may be of different natures and may be snapped on said ends (22, 23), the latter having pins (24) with a resilient effect, capable of cooperating with recesses of complementary members (not shown) formed within said end pieces.

Thus, the end pieces may be made of different materials, particularly a flexible and/or resilient material, or even deliver perfumed scents or generate an icy feeling. They may in particular be made of polypropylene, polyethylene, polyurethane, elastomer, or stainless steel.

The free lower end of the end pieces (14 and 15) may take a convex shape, to favor the contact with the patient's skin.

Further, one of the end pieces (14 and 15) may be replaced with a roller (5) assembled to freely rotate. The rotation axis of the roller is parallel to the hinge line of the flap supports in the housing, and is further perpendicular to the rotation axis of the rotary cam (8).

Figure 6:
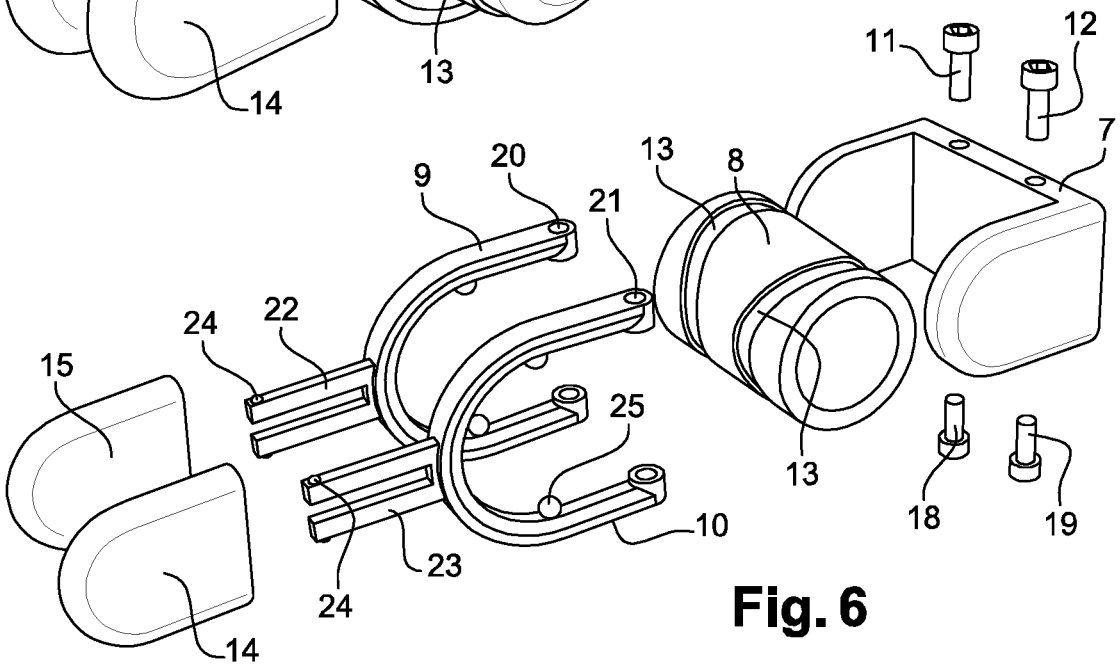
FIG. 6 is a simplified exploded view of means described in relation with FIGS. 4 and 5.

As shown in FIG. 6, particularly, the periphery (26) of the rotary cam (8) has two rippled continuous recesses or grooves (13), symmetrical to each other with respect to a median plane of the cam (8). The recesses (13) are intended to cooperate with one or two pins (25), emerging from the flap supports (9 and 10), as can be particularly observed in FIGS. 7 and 8.

Figure 7:
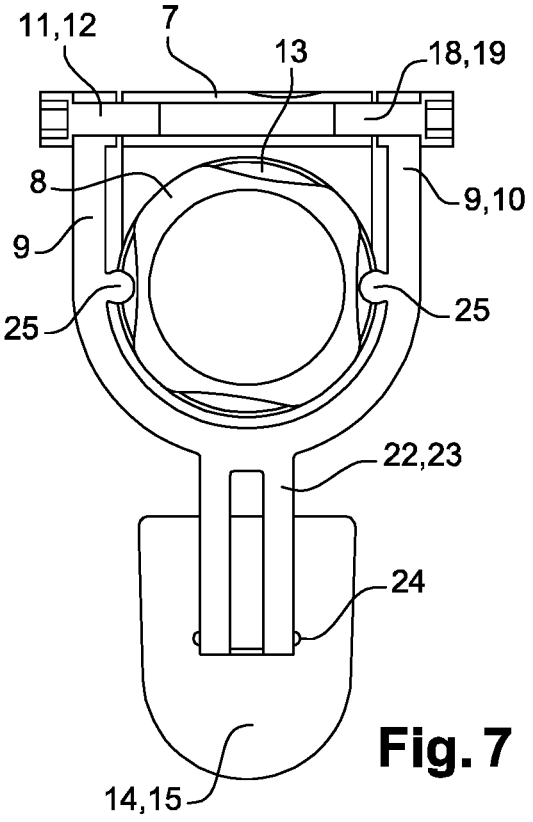
FIGS. 7 and 8 are simplified representations illustrating two variations of cooperation of the flap support with the cam.

In a first configuration, the supports (9 and 10) comprise two substantially median pins (25) cooperating with the cam tracks (13) along a diameter of said cam (FIG. 7).

Figure 8:
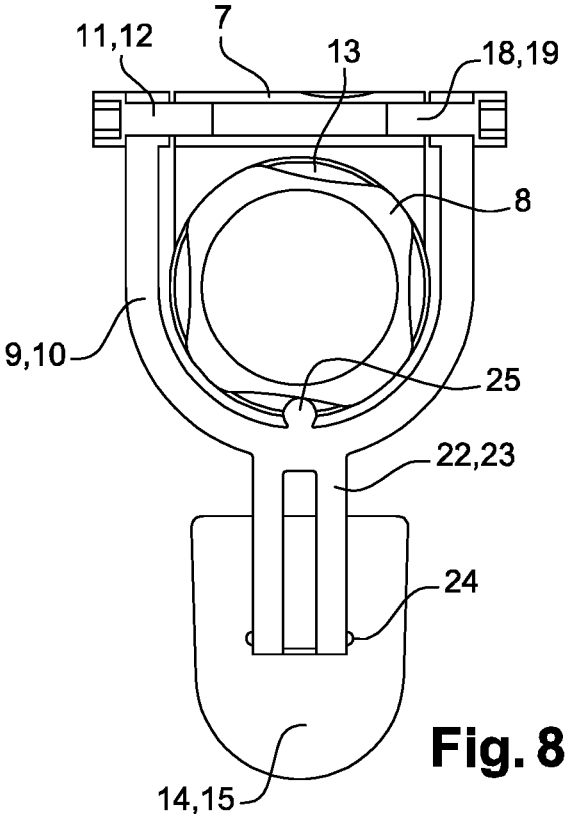
Figure 9:
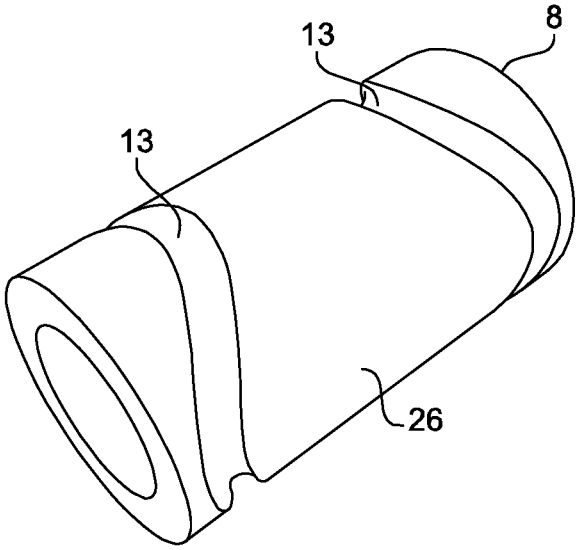
FIG. 9 is a simplified perspective representation of an embodiment of the cam.
Figure 10:
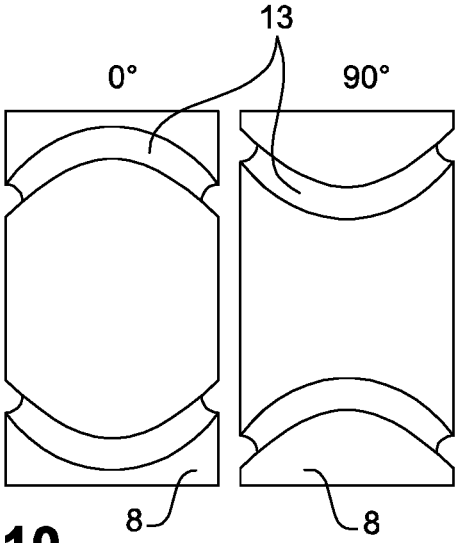
FIG. 10 shows the cam of FIG. 9 along two different orientations, respectively at 0° and at 90° with respect to its rotation.

According to another configuration shown in FIG. 8, said supports (9 and 10) comprise a single pin (25) only cooperating with the cam track in the lower portion of the cam.

The choice of using one or two pins for example results from the will to have more torque, and thus more effort exerted by the free lower end of the flaps and, thereby, more pinching intensity.

Figure 13:
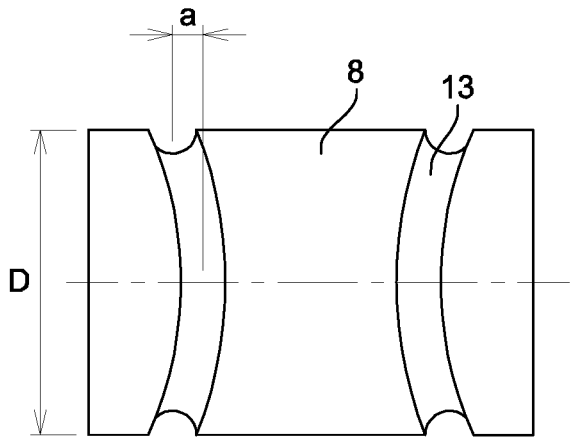
FIGS. 13, 14, and 15 illustrate alternative cam tracks.
Figure 14:
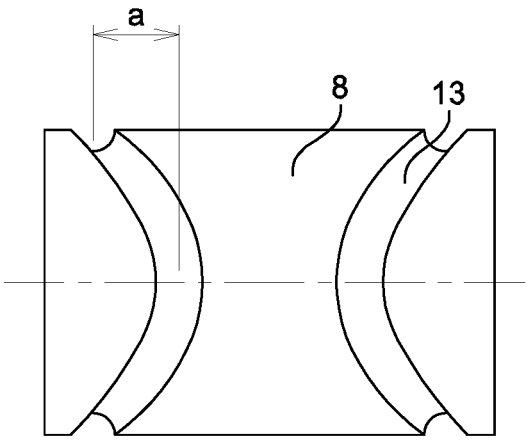
Figure 15:
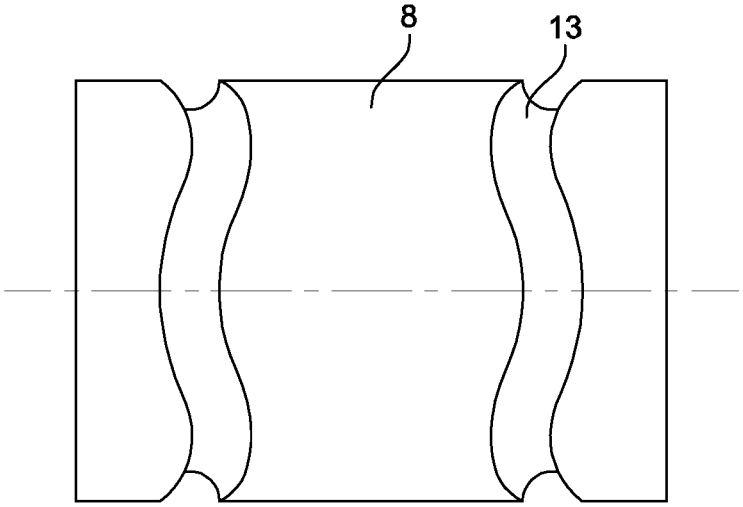

Various alternative cam tracks are shown in relation with FIGS. 13 to 15. In FIG. 13, the amplitude of the ripple of the cam tracks (13), materialized by distance a, is small.

In FIG. 14, the ripple is more significant. The consequences of such a modification will be indicated hereafter.

In FIGS. 13 and 14, the cam track comprises two ripples per revolution only. In FIG. 15, the cam track exhibits four ripples per revolution. The increase of the number of ripples per revolution of course translates as an increase of the number of times the flaps pivot per revolution of the cam, and thus, for a given cam rotation speed, as a multiplication of the number of times the flaps pivot.

Figure 11:
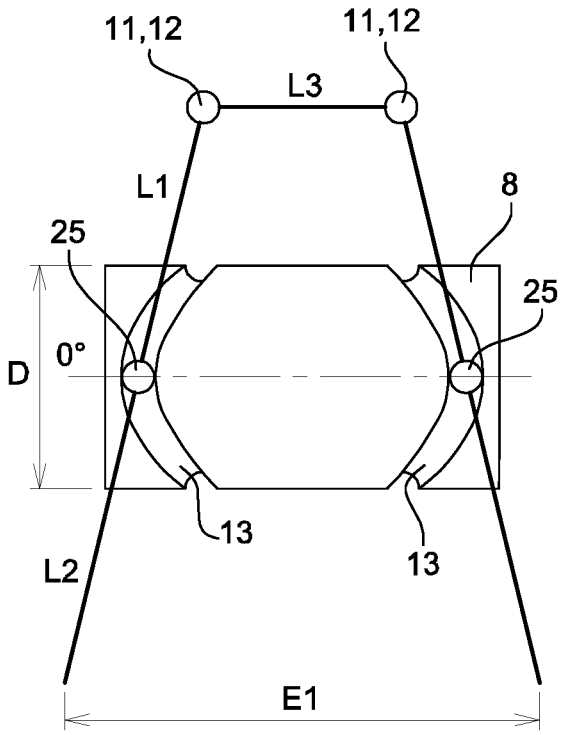
FIGS. 11 and 12 schematically illustrate the effects generated by the cooperation of the pins of the flap supports with the cam.
Figure 12:
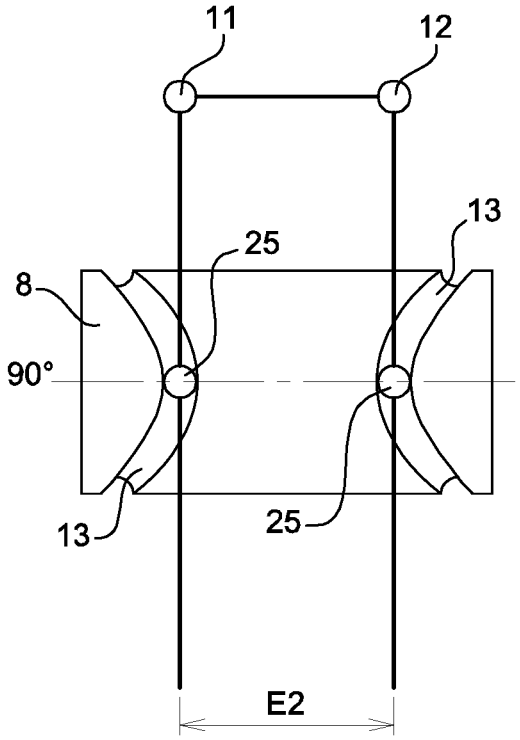

The consequences of the respective positioning of these different elements on the action exerted by the flaps on the patient's skin are shown in relation with FIGS. 11 and 12. Thus, the amplitude of the above-targeted ripple a defines the interval E1, respectively E2 (see FIGS. 11 and 12) between the free lower edges of the flaps. In other words, the larger the ripple amplitude, the larger stroke E1-E2 of the free lower end of the flap will be. The combination of lengths L1 (length between the hinge line (11, 12) of the flap support and the pin (25)), L2 (length between the pin (25) and the free lower edge of the end piece of the flap) and L3 (distance separating the two hinge lines of the flap supports) defines intervals E1 and E2 as well as the pinching force.

As a result of these elements, the constructor may vary these various parameters to define the desired pinch effort, and the positions of the open and closed flaps.

Figure 16:
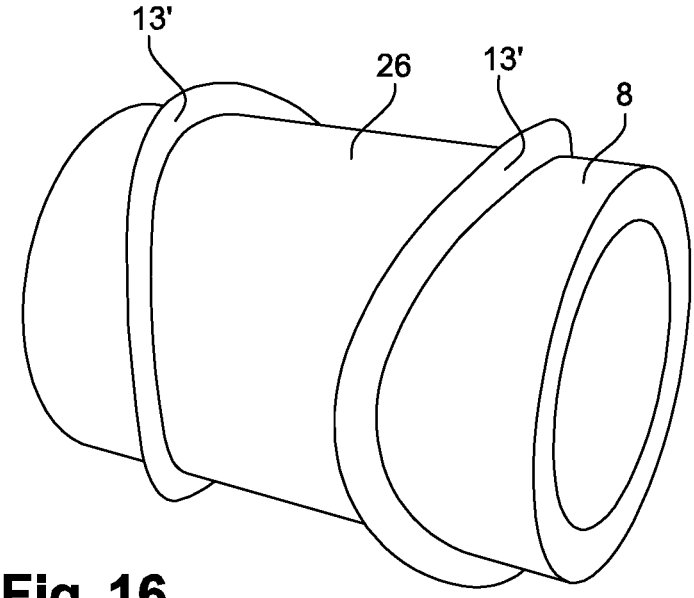
FIG. 16 is a simplified perspective representation of another embodiment of the cam track, implementing, instead of a recess, a protruding outgrowth.

Another embodiment is shown in relation with FIG. 16. In this embodiment, the cam tracks formed at the periphery (26) of the cam (8) are no longer formed by recesses or grooves, but by outgrowths (13') protruding from said periphery. Under this assumption, the means (25) formed inside of the flap supports (9 and 10) and intended to cooperate with the cam track, are no longer formed by pins, but are replaced with a fork having its two branches which position on either side of the protruding outgrowths (13'). The result obtained in terms of displacement of the flaps is identical to that of the previous embodiment.

Figure 17:
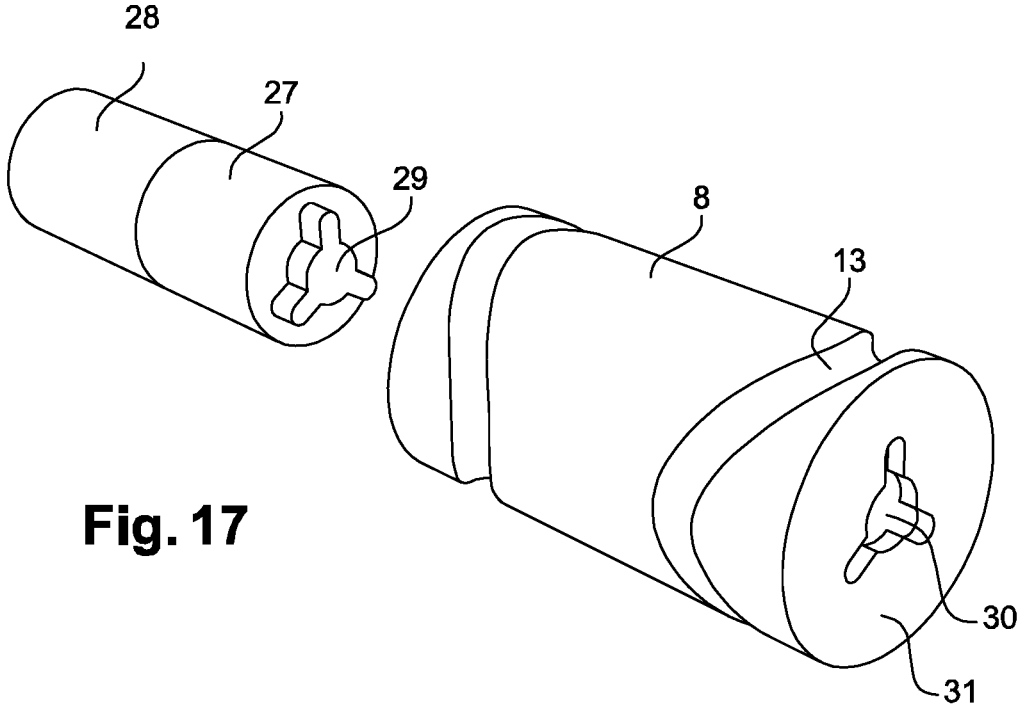
FIGS. 17 and 18 schematically illustrate two cam rotation modes.

The rotation of the cam (8) may be obtained by different means. Thus, and according to a first embodiment described in relation with FIG. 17, the rotation of the cam (8) is obtained by means of a reduction gear (27) driven by an electric motor (28), the assembly of the motor and of the reduction gear (27, 28) being affixed and housed within the cylindrical cam (8). The output shaft of the reduction gear is provide with a pinion (29) which cooperates with one of the ends (31) of the cam, having a shape (30) complementary to the pinion (29) of the output shaft of the reduction gear. Under this assumption, the cam is hollow to enable to receive the geared motor (27, 28) and the rotation of the end (31) of the cam generates the rotation of a peripheral sleeve having the cam tracks (13, 13') formed inside of it. Thus, and in such a configuration, the pinion (29) is located in the rotation axis of the cam.

The electric power supply of the motor, not shown, conventionally reaches the level of the lateral walls of the support (7). This specific embodiment enables to very significantly decrease the bulk of the massage head.

Figure 18:
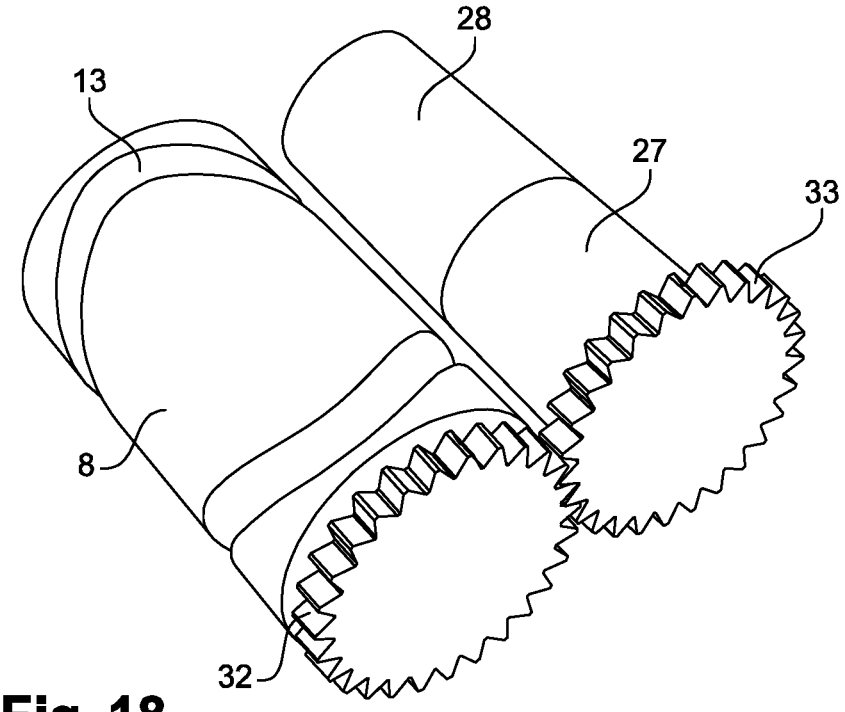

According to another embodiment shown in FIG. 18, the rotation of the cam is here obtained again by a motor/reduction gear pair (27, 28), external to the cam, via a toothed wheel (33) assembled on the drive shaft of the reduction gear (27). The toothed wheel meshes with a pinion (32) rigidly fastened to the cam, and having its rotation axis coinciding with the rotation axis of the cam. It can be understood that such an embodiment generates a more significant bulk of the massage head.

In this configuration, the toothed drive pinion (33) is thus offset with respect to the rotation axis of the cam (8).

Figure 19:
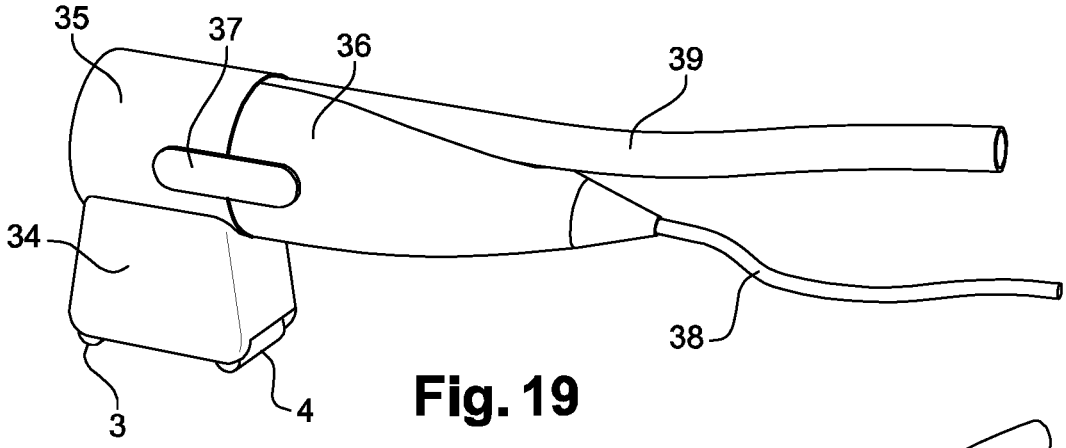
FIGS. 19, 20, and 21 illustrate a massage head with a removable housing according to another embodiment.
Figure 20:
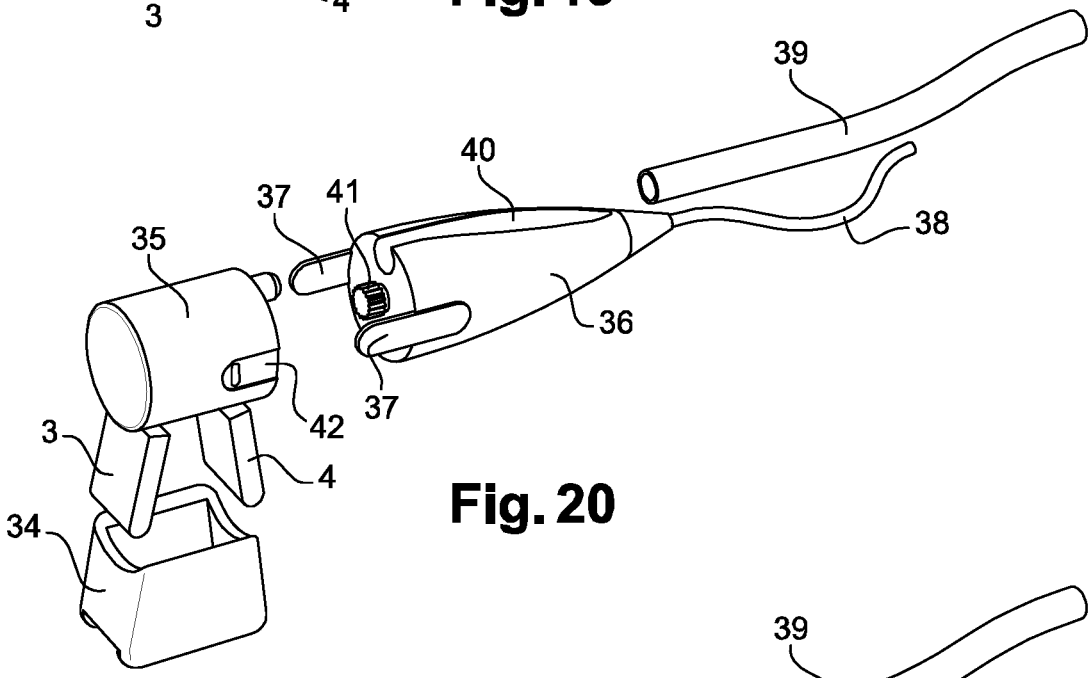
Figure 21:
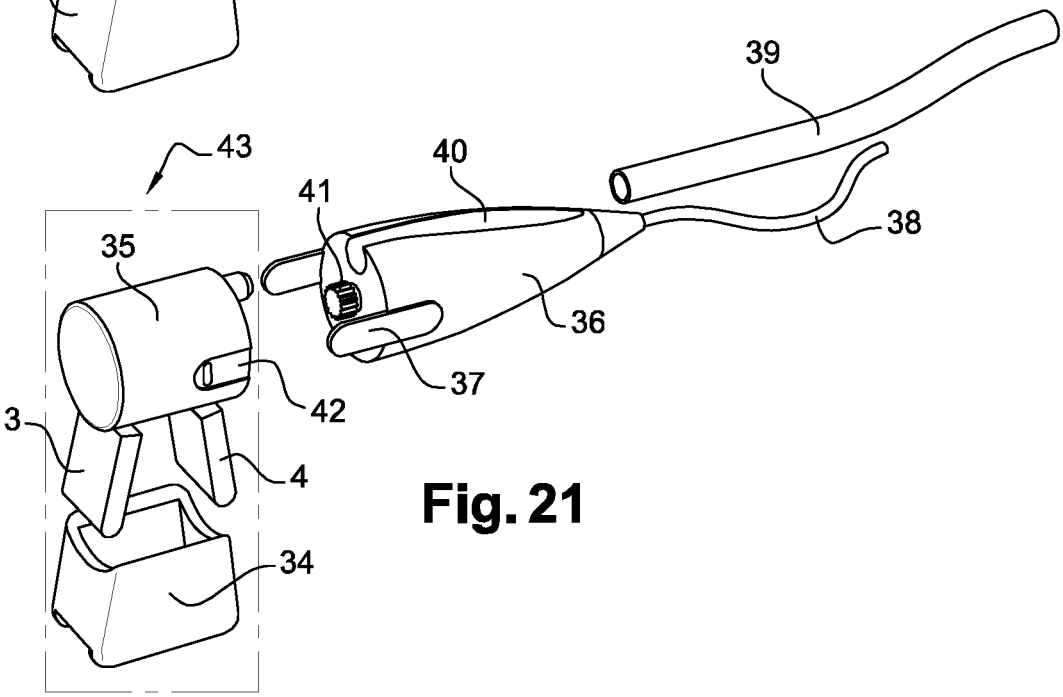

According to still another embodiment, for example, shown in relation with FIGS. 19 to 21, the rotation of the cam (8) is here again obtained by the principle of the meshing of a drive toothed wheel (41) directly or indirectly cooperating with the pinion (32) of the cam. However, in such a configuration, the motorization is no longer integrated in the body (35) of the housing, but rather in the actual massage head (36), said head being capable of being separated from the housing integrating the means ensuring the displacement of the flaps. This notion of separation is well shown in FIG. 21, since, under this assumption, the assembly (43) integrating the rotary cam and the flaps, on the one hand, and the head (36), integrating the motor and the reduction gear rotating the toothed wheel (41) on the other hand, can be distinguished. This head (36) is where the electric power supply (38) necessary to the operation of the motor ends, as well as, if present, the pipe (39) coupled to a suction or depression source, housed in a recess (40) provided for this purpose for user-friendliness reasons. The fastening of the assembly (43) to the head (36) is performed by means of resilient tabs or clips (37) receiving in housings (42) formed on two opposite walls of the assembly (43), that is, of the housing.

In this specific embodiment, a treatment chamber, advantageously removable, inside of which, on the one hand, the flaps (3 and 4) may pivot and where, on the other hand, the suction or depression source ends, has also been designated with reference (34). The free lower end of the treatment chamber is intended to come into contact with the patient's skin, to enable, when the head is coupled to a suction or depression source, to optimize the effect resulting from the suction.

In this specific embodiment, it can be observed that the assembly (43) comprises no electric component. Thus, the assembly (43) which, as already mentioned, can be separated from the head (36), may be easily cleaned and then sterilized. For this purpose, its different components are made of materials resistant to disinfectants and to sterilization, such as, for example, polyamide, PEEK (polyetheretherketone), thermoplastic polyurethane, stainless steel. Further, the air sucked into the processing chamber (34) does not contaminate the motorization system and the control means, integrated in the actual head (and not shown).

The advantage thus appears, due to the many benefits that it provides.

First, the simplification of the motorization and flap pivoting system will have been well understood, in addition to the bulk decrease generated by the system. Similarly, the provided possibility of varying, by construction, the effects resulting from the action of the flaps, particularly in terms of pivoting speed and of pinch effort, will be well understood.

Further, it can also be conceived that in a version enabling to separate the purely mechanical aspect from the electrical aspect, the maintenance, the sterilization, and the cleaning of the massage head are significantly eased and optimized in terms of quality.

The invention claimed is:

1. A massage head comprising a housing, having two active members emerging from a lower surface thereof, a free lower edge of said active members, opposite to the housing, intended to be in contact with a patient's skin, at least one of said active members being formed of a flap hinged within the housing and capable of being pivoted to bring the free lower edges of said active members closer to each other or to draw them away from each other along a displacement direction, the relative displacement of said at least one flap relative to the housing being ensured by means of a rotary cam formed within the housing, wherein the rotation axis of the cam is oriented parallel to the displacement direction of said at least one flap;

wherein the cam comprises at least one cam track formed on the periphery of said cam;

and wherein said at least one flap is assembled on a support said support having an end hinged in the housing, said support being provided with a member capable of cooperating with the cam track.

2. The massage head of claim 1, wherein the active members are respectively formed of a fixed wall and of a flap, only said flap having a pivoting motion.

3. The massage head of claim 2, wherein the free lower edge of the active members, intended to come into contact with the patient's skin, is formed of a removable end piece reversibly affixed on the flap support and on the fixed wall.

4. The massage head of claim 3, wherein the end pieces take different configurations and shapes and are made of a flexible and/or abrasive material, and are capable of delivering perfumed scents or of generating an icy feeling.

5. The massage head of claim 3, wherein at least one of the end pieces is formed of a freely rotating roller having a rotation axis oriented parallel to a hinge line of the flap supports within the housing, or perpendicularly to the rotation axis of the cam.

6. The massage head of claim 1, wherein both of the active members are formed of respective flaps hinged within the housing by means of respective supports, each of said supports cooperating with a cam track formed at the periphery of the rotary cam.

7. The massage head of claim 6, wherein the free lower edge of the active members, intended to come into contact with the patient's skin, is formed of a removable end piece reversibly affixed on the flap supports.

8. The massage head of claim 7, wherein the end pieces take different configurations and shapes and are made of a flexible and/or abrasive material, and are capable of delivering perfumed scents or of generating an icy feeling.

9. The massage head of claim 7, wherein at least one of the end pieces is formed of a freely rotating roller having a rotation axis oriented parallel to a hinge line of the flap supports within the housing, or perpendicularly to the rotation axis of the cam.

10. The massage head of claim 1, wherein the cam tracks are each formed of a continuous recess formed at the periphery of the cam, and wherein the member of the support of the flap(s) cooperating with said cam track is formed of at least one pin received in said recess.

11. The massage head of claim 1, wherein the cam track(s) are each formed of a continuous outgrowth protruding from the periphery of the cam, and wherein the member of the support of the flap(s) cooperating with said cam track is formed of at least one fork, the fork having teeth positioned on either side of said outgrowth.

12. The massage head of claim 1, wherein the rotation of the cam is ensured by means of a motor paired with a reduction clear, said motor and reduction gear fixedly assembled within the cam, having the rotation shaft of the reduction gear generating the rotation of a peripheral sleeve fitting the cam, having the cam track(s) formed thereon.

13. The massage head of claim 1, wherein the rotation of the cam is ensured by means of a motor paired with a reduction clear, said motor and reduction gear assembled within the housing, but external to the cam, a drive shaft of the reduction gear being provided with a toothed wheel meshing with a pinion rigidly fastened to the cam, the pinion having a rotation axis coinciding with the rotation axis of the cam.

14. The massage head of claim 1, wherein the housing integrating rotary cam is capable of being separated from the massage head, and wherein the rotation of the cam is ensured by means of a motor rotating a toothed wheel directly or indirectly meshing with a pinion rigidly fastened to the cam, the pinion having a rotation axis coinciding with the rotation axis of the cam, said motor being integrated in the actual massage head, externally to said housing.

15. The massage head of claim 14, wherein fastening the head to, and separating the head from, the housing is performed by means of resilient tabs or clips received in housings formed on two opposite walls of the housing.

16. The massage head of claim 14, wherein the housing integrates a removable treatment chamber within which the flap(s) are capable of pivoting, the free lower edge of the flaps of the treatment chamber being intended to come into contact with the patient's skin.

17. A massage device using the massage head of claim 1, and comprising an electric power source capable of powering an electric motor driving a reduction gear or ensuring the rotation of the cam.

18. The massage device of claim 17, further comprising a vacuum or depression source associated with the massage head, and emerging into the massage head.

* * * * *